US010921741B2

(12) United States Patent
Shindo et al.

(10) Patent No.: US 10,921,741 B2
(45) Date of Patent: Feb. 16, 2021

(54) IMAGE FORMING APPARATUS CONFIGURED TO MINIMIZE SHEET EDGE SOILING

(71) Applicant: CANON KABUSHIKI KAISHA, Tokyo (JP)

(72) Inventors: Kenji Shindo, Yokohama (JP); Takayuki Kanazawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/399,653

(22) Filed: Apr. 30, 2019

(65) Prior Publication Data

US 2019/0339639 A1 Nov. 7, 2019

(30) Foreign Application Priority Data

May 2, 2018 (JP) ..... JP2018-088843

(51) Int. Cl.
*G03G 15/00* (2006.01)
*G03G 15/16* (2006.01)

(52) U.S. Cl.
CPC ..... *G03G 15/5045* (2013.01); *G03G 15/1665* (2013.01); *G03G 15/5062* (2013.01)

(58) Field of Classification Search
CPC ..... G03G 15/5029; G03G 15/5045; G03G 15/043–047; G03G 15/50; G03G 15/14–18; G03G 2215/0431–0443
USPC ..... 399/51, 66
See application file for complete search history.

(56) References Cited

U.S. PATENT DOCUMENTS

| | | | | |
|---|---|---|---|---|
| 7,050,732 | B2 * | 5/2006 | Bae | G03G 15/0266 399/50 |
| 8,049,931 | B2 * | 11/2011 | Takahashi | H04N 1/40087 358/3.1 |
| 9,141,071 | B2 * | 9/2015 | Adachi | G03G 21/0064 |
| 9,599,923 | B2 * | 3/2017 | Kitamura | G03G 15/5008 |
| 9,958,803 | B2 * | 5/2018 | Araki | G03G 15/043 |

FOREIGN PATENT DOCUMENTS

| | | |
|---|---|---|
| JP | 2006-221048 A | 8/2006 |
| JP | 2011-203758 A | 10/2011 |
| JP | 2013-222151 A | 10/2013 |

OTHER PUBLICATIONS

Machine-translation of JP 2012-095034 (Year: 2013).*

* cited by examiner

*Primary Examiner* — Walter L Lindsay, Jr.
*Assistant Examiner* — Arlene Heredia
(74) *Attorney, Agent, or Firm* — Canon U.S.A., Inc. IP Division

(57) ABSTRACT

In an image forming apparatus of a direct transfer system, when in a region where a transfer nip portion of a photosensitive drum is formed, a region in which the toner image can be formed is defined as a first region, and a region where the recording medium does not pass while the recording medium is conveyed by the transfer nip portion is defined as a second region, in forming the toner image on the recording medium, the photosensitive drum enters the transfer nip portion in a state where the second region of the photosensitive drum includes a region in which an absolute value of a surface potential is smaller than an absolute value of a surface potential of a region in which the toner image is not formed in the first region.

7 Claims, 17 Drawing Sheets

IMAGE FORMING APPARATUS CONFIGURED TO MINIMIZE SHEET EDGE SOILING

BACKGROUND OF THE INVENTION

Field of the Invention

The present disclosure relates to an image forming apparatus such as an electrophotographic copier, a laser beam printer, and a facsimile.

Description of the Related Art

Conventionally, in an image forming apparatus such as a copier and a printer, image forming system such as an electrostatic recording system and an electrophotographic recording system are often used.

As an image forming system, a direct transfer system is known. In the direct transfer system, a recording medium is conveyed between a photosensitive member and a transfer member, and a toner image is formed on the surface of the photosensitive member, and transferred onto the recording medium, at a transfer unit, utilizing a potential difference between the photosensitive member and the transfer member.

In the direct transfer system, if the length of a recording medium in the direction perpendicular to the conveyance direction is shorter than the length in the rotational axis direction of the photosensitive member, a sheet-passing portion and a non-sheet-passing portion are formed on a nip portion of the transfer member (i.e., transfer contact portion). The sheet-passing portion is the portion where the photosensitive member comes into contact with the recording medium. The non-sheet-passing portion is the place where the photosensitive member does not come into contact with the recording medium. Accordingly, developer due to development on the photosensitive member in the non-sheet-passing portion may adhere to the transfer member. When a recording medium of a different size is conveyed after the adherence, the back side of the recording medium is soiled with the developer. In order to prevent the soiling on the back side, Japanese Patent Application Laid-Open No. 2006-221048 discusses a technique for reducing the volume of the developer transferred on the non-sheet-passing portion by adjusting the surface potential of the photosensitive member in the non-sheet-passing portion.

However, when the technique discussed in Japanese Patent Application Laid-Open No. 2006-221048 is used, the following circumstances arise. In the case where transfer is performed on a recording medium having a length in the direction perpendicular to the conveyance direction of the recording medium which is shorter than the length of the transfer member in the rotational axis direction, electric current that would flow to the recording medium side, which is a sheet-passing portion, flows to the photosensitive member side, which is a non-sheet-passing portion, near the edge of the recording medium. Depending on the conditions of the recording medium, an electrical resistance of the recording medium may be high, and then the transfer current may be difficult to flow through the sheet-passing portion. To transfer the developer to the recording medium, a voltage having a polarity opposite to the potential of the surface of the photosensitive member is applied to the transfer member. Thus, a current flowing through the non-sheet-passing portion may oppositely charge the surface of the photosensitive member in the non-sheet-passing portion.

On the surface of the oppositely charged photosensitive member, another potential is formed after transferring to form a next image. However, the surface potential of the photosensitive member does not reach a desired potential due to an effect of the opposite charging at the nip portion. Therefore, the developer adheres to the non-image forming region in a developing apparatus, so that the developer is transferred to the transfer member, and if the recording medium of the same size continuously passes in this state, the edge of the recording medium may be soiled.

SUMMARY OF THE INVENTION

The present disclosure is directed to reducing a volume of soiling on recording media in the direct transfer system.

According to a first aspect of the disclosure, an image forming apparatus includes an image bearing member that is rotatable, a charging member configured to charge a surface of the image bearing member, a developing member configured to develop a toner image on the image bearing member by supplying toner to the surface of the image bearing member charged by the charging member, a transfer member configured to form a nip portion by contacting with the image bearing member, and to transfer the toner image developed on the image bearing member at the nip portion to a recording medium, a voltage applying unit configured to apply a transfer voltage to the transfer member while the toner image is transferred from the image bearing member to the recording medium, and an acquisition unit configured to acquire information on a size of the recording medium, wherein in a region where the nip portion of the image bearing member is formed, a region in which the toner image can be formed is defined as a first region, and a region where the recording medium does not pass while the recording medium is conveyed by the nip portion is defined as a second region, wherein, based on the information acquired by the acquisition unit, an edge position of the recording medium in a direction perpendicular to a conveyance direction of the recording medium and the first region are identified, and wherein in forming the toner image on the recording medium, the image bearing member enters the nip portion in a state where the second region of the image bearing member includes a region in which an absolute value of a surface potential is smaller than an absolute value of a surface potential of a region in which the toner image is not formed in the first region.

Further features of the present disclosure will become apparent from the following description of exemplary embodiments with reference to the attached drawings.

DESCRIPTION OF THE EMBODIMENTS

A developing unit, a cartridge, and an image forming apparatus according to exemplary embodiments of the present disclosure will be described below with reference to the drawings. However, the dimensions, materials, shapes, and relative arrangements of components described in the following exemplary embodiments should be appropriately changed depending on the configuration of the apparatus to which the present disclosure is applied and various conditions. Thus, it is not intended that the scope of the present disclosure is limited to the dimensions, materials, shapes, and relative arrangements unless otherwise specified.

1. Image Forming Apparatus

Figure 1:
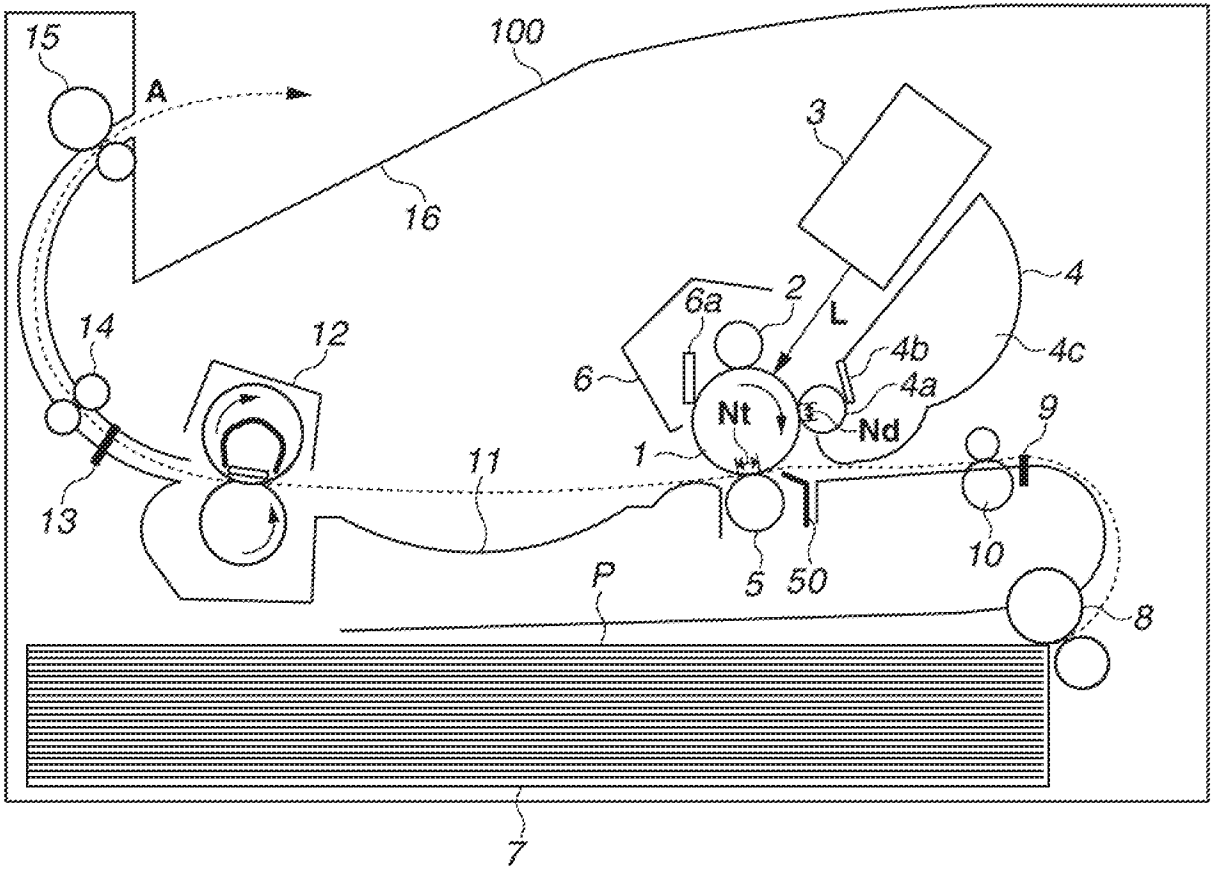
FIG. 1 is a schematic diagram of an image forming apparatus according to a first exemplary embodiment.

A configuration of a laser beam printer (hereinafter referred to as "image forming apparatus") will be described with reference to FIG. 1.

An image forming apparatus 100 includes a drum type electrophotographic photosensitive member 1 (hereinafter referred to as "photosensitive drum 1") that is rotationally supported as an image bearing member. The photosensitive drum 1 is formed by providing a photosensitive material such as an organic photo-semiconductor (OPC), amorphous selenium, or amorphous silicon on a surface of a drum base of a cylinder, which is made of aluminum, nickel or the like, with a diameter of 24 mm. The photosensitive drum 1 is rotationally supported by the image forming apparatus 100, and is rotationally driven by a driving source (not illustrated) in the direction of an arrow R1 at a process speed of 150 mm/s. In the present exemplary embodiment, the photosensitive material has a thickness of 15 μm.

Around the photosensitive drum 1, a charging member (i.e., charging roller) 2, an exposure unit 3, a developing unit 4, a transfer member (i.e., transfer roller) 5, and a cleaning member 6 are arranged in this order along the rotation direction of the photosensitive drum 1.

At the bottom of the image forming apparatus 100, a sheet feeding cassette 7 containing transfer media P such as sheets is disposed. Along the conveyance path of the recording media P, a sheet feeding roller 8, a top sensor 9, a conveyance roller pair 10, a pre-transfer guide member 50, a conveyance guide 11, a fixing device 12, a sheet discharge sensor 13, a conveyance roller 14, a sheet discharge roller 15, and a sheet discharge tray 16 are arranged in this order.

The charging roller 2 is a single-layer roller including a conductive core metal and a conductive rubber layer. The charging roller 2 has a volume resistivity of $10^3$ to $10^6$ Ω·cm. The charging roller 2 is in contact with the photosensitive drum 1 and rotates around the conductive core metal interlocking with a rotation of the photosensitive drum 1. A charging voltage applying unit 21, which applies a direct current charging voltage (i.e., charging bias) having a negative polarity, is connected to the conductive core metal.

Figure 2:
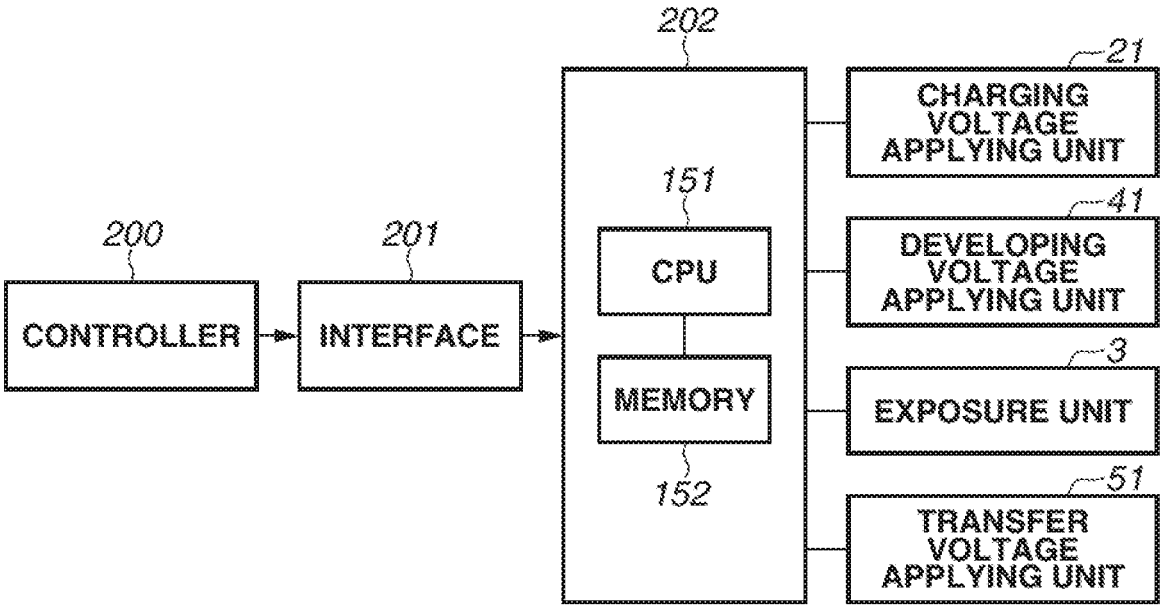
FIG. 2 is a control block diagram according to the first exemplary embodiment.

Time-series digital pixel signals of image information are input to the exposure unit 3, which is an exposure means. As illustrated in FIG. 2, the digital pixel signals have been input to a control unit 202 from a printer controller 200 through an interface 201 and have been subjected to image processing. The exposure unit 3 includes a laser output unit that outputs a laser beam having been modulated corresponding to the input time-series digital pixel signals, a rotatable polygonal mirror (i.e., polygon mirror), an fθ lens, a reflecting mirror, and the like and performs main scanning exposure, with a laser beam L, on the surface of the photosensitive drum 1. The main scanning exposure in combination with sub scanning by the rotation of the photosensitive drum 1 forms an electrostatic latent image corresponding to the image information.

The developing unit 4 contains toner (i.e., developer) having negative polarity and includes a developing roller 4*a* (i.e., developer carrier) as a developing member. The developing roller 4*a* carries the toner contained in the developing unit 4, and is close to the photosensitive drum 1 with a predetermined clearance. A developing voltage applying unit 41 that can apply an alternating developing voltage (i.e., developing bias) is connected to the developing roller 4*a*.

A transfer roller 5 includes a conductive core metal and a semi-conductive sponge and adjusts the resistance using an ion conductive material. The semi-conductive sponge is mainly composed of a nitrile butadiene rubber (NBR) Hydrin rubber and includes an elastic member at a pressure contact part against the photosensitive drum 1. The outer diameter of the transfer roller 5 is 12.5 mm and the outer diameter of the core metal is 6 mm. The resistance value of the transfer roller 5, when a voltage of 2 kilo V is applied, is 1.0 to $3.0\times10^8$Ω under a normal-temperature of 23° C. and a normal-humidity environment of 50%. The resistance value takes $0.5\times10^8$Ω under a high-temperature of 32° C. and a high-humidity environment of 80%, and $8.0\times10^8$Ω under a low-temperature of 15° C. and a low-humidity environment of 10%. In the same manner, the resistance value varies depending on an environment. In a state where a recording medium P is not interposed, the transfer roller 5 comes into contact with the photosensitive drum 1 at the transfer contact position (i.e., nip portion), and the transfer roller 5 rotates around the conductive core metal interlocking with the rotation of the photosensitive drum 1. A transfer voltage applying unit 51, to which a transfer voltage (i.e., transfer bias) having a positive polarity is applied, is connected to the conductive core metal.

FIG. 2 is a block diagram illustrating a schematic control mode of a main part of the image forming apparatus 100 according to the present exemplary embodiment. The controller 200 transmits and receives various kinds of electrical information to and from a host apparatus, and collectively controls image forming operation of the image forming apparatus 100 according to a predetermined control program and a reference table via the control unit 202. The image forming apparatus 100 includes a control unit 202 as a control means for collectively controlling the operation of each unit of the image forming apparatus 100. The control unit 202 includes a central processing unit (CPU) 151, which is a core element for performing various kinds of calculation processing, and a memory 152 such as a read only memory (ROM) and a random access memory (RAM), which are storage elements. The RAM stores, for example, detection results from a sensor, count results from a counter, calculation results. The ROM stores, for example, a control program, a data table acquired in advance by experiments. Various units to be controlled, a sensor unit, a counter unit, and the like in the image forming apparatus 100 are connected to the control unit 202.

The control unit 202 controls a transmission and reception of various kinds of information signals and the timing for driving each unit and thus controls a predetermined image forming sequence. For example, the control unit 202 controls voltages applied to the charging roller 2, the developing roller 4*a*, and the transfer roller 5 through the charging voltage applying unit 21, the developing voltage applying unit 41, and the transfer voltage applying unit 51 respectively. The image forming apparatus 100 forms an image on the recording medium P based on an electrical image signal input to the controller 200 from a host apparatus. The host apparatus may be an image reader (i.e., original image reading apparatus), a personal computer, a facsimile, a smartphone, or the like.

2. Image Forming Process

Next, an image forming process operation of the present exemplary embodiment will be described.

The photosensitive drum 1 is rotationally driven in the direction of the arrow R1 by a driving source (not illustrated) and uniformly charged to a predetermined polarity and a predetermined potential by the charging roller 2.

After the charging, the exposure unit 3 performs image exposure L on the image portion and the non-image portion (i.e., inside and outside of the image region) of the photosensitive drum 1 with respective light emission amounts based on the image information, and then the charge is removed depending on the exposure amount to form an electrostatic latent image.

The electrostatic latent image is developed by the developing unit 4. The developing unit 4 includes the developing roller 4*a*, a developing blade 4*b*, and a toner container 4*c*. When the toner stored in the toner container 4*c* is supplied to the developing roller 4*a*, the toner is conveyed to the position of the developing blade 4*b* by the rotational driving of the developing roller 4*a*. After the toner passes through the developing blade, uniform toner coat charged to a negative polarity is formed on the developing roller 4*a*. The developing roller 4*a* comes into contact with the photosensitive drum 1 while driving the photosensitive drum 1 keeping a constant difference in peripheral speed and form a developing nip portion Nd as illustrated in FIG. 1. When the developing voltage applying unit 41 applies a developing voltage to the developing roller 4*a*, the electrostatic latent image on the photosensitive drum 1 is developed as a toner image.

The toner image is transferred to the recording medium P such as a paper sheet by the transfer roller 5 serving as a transfer member. The transfer roller 5 is a contact member that faces and comes in contact with the photosensitive drum 1, and forms a contact portion with the photosensitive drum 1. A transfer pressurizing spring (not illustrated) presses the transfer roller 5 against the photosensitive drum 1 at the contact portion. Then the transfer roller 5 forms a transfer nip portion Nt between the transfer roller 5 and the photosensitive drum 1. Here, the transfer nip portion Nt is defined as a contact portion formed when the transfer roller 5 comes into contact with the photosensitive drum 1. Thus, the transfer nip portion Nt may be formed by the transfer roller 5 directly pressing the photosensitive drum 1 as in the present exemplary embodiment, or by the transfer roller 5 pressing the photosensitive drum 1 via a conveyance member that is a belt-shaped member for conveying the recording medium P to the transfer nip portion Nt. Recording media P are stored in the sheet feeding cassette 7, fed one by one by the sheet feeding roller 8, conveyed by the conveyance roller 10, and conveyed along a conveyance route A. In the vicinity of the transfer portion, a recording medium is conveyed to the transfer nip portion Nt between the photosensitive drum 1 and the transfer roller 5 while being guided by the pre-transfer guide member 50. At this time, the leading edge of the recording medium P is detected by the top sensor 9, and the recording medium P is synchronized with the toner image on the photosensitive drum 1. A transfer voltage having a polarity opposite to the charge polarity of the toner is applied to the transfer roller 5 by the transfer voltage applying unit 51, whereby the toner image on the photosensitive drum 1 is transferred to a predetermined position on the recording medium P.

A cleaning blade 6*a* as a cleaning member 6 scrapes off a small amount of toner remaining on the photosensitive drum 1 after the transfer is performed, to be used in the next image formation.

After the transfer, the recording medium P carrying an unfixed toner image on the surface is conveyed along the conveyance guide 11 to the fixing device 12, where the unfixed toner image is heated and pressed to be fixed on the surface of the recording medium P.

After the toner image is fixed, the leading edge of the recording medium P is detected by the sheet discharge sensor 13. The recording medium P is then conveyed by the conveyance roller 14, and is discharged onto the sheet discharge tray 16 on the upper surface of the main body of the image forming apparatus 100 by the sheet discharge roller 15.

In the image forming apparatus 100 of the present exemplary embodiment, the size of the recording medium P on which an image is formed is set by a user in advance when determining an image forming, and information about the size of the recording medium P is transmitted to an acquisition unit (not illustrated). Based on the information of the recording medium P stored in advance in the memory 152, the edge position of the recording medium P in the direction perpendicular to the conveyance direction of the recording medium P and a toner image formable region on the photosensitive drum 1 for forming a toner image on the recording medium P in the rotational axis direction of the photosensitive drum 1 are transmitted to the control unit 202. The rotational axis direction of the photosensitive drum 1 is the same as the direction perpendicular to the conveyance direction of the recording medium P. A sensor for detecting the longitudinal width of the recording medium P in the direction of the rotational axis of the photosensitive drum 1 may be disposed separately.

Figure 3:
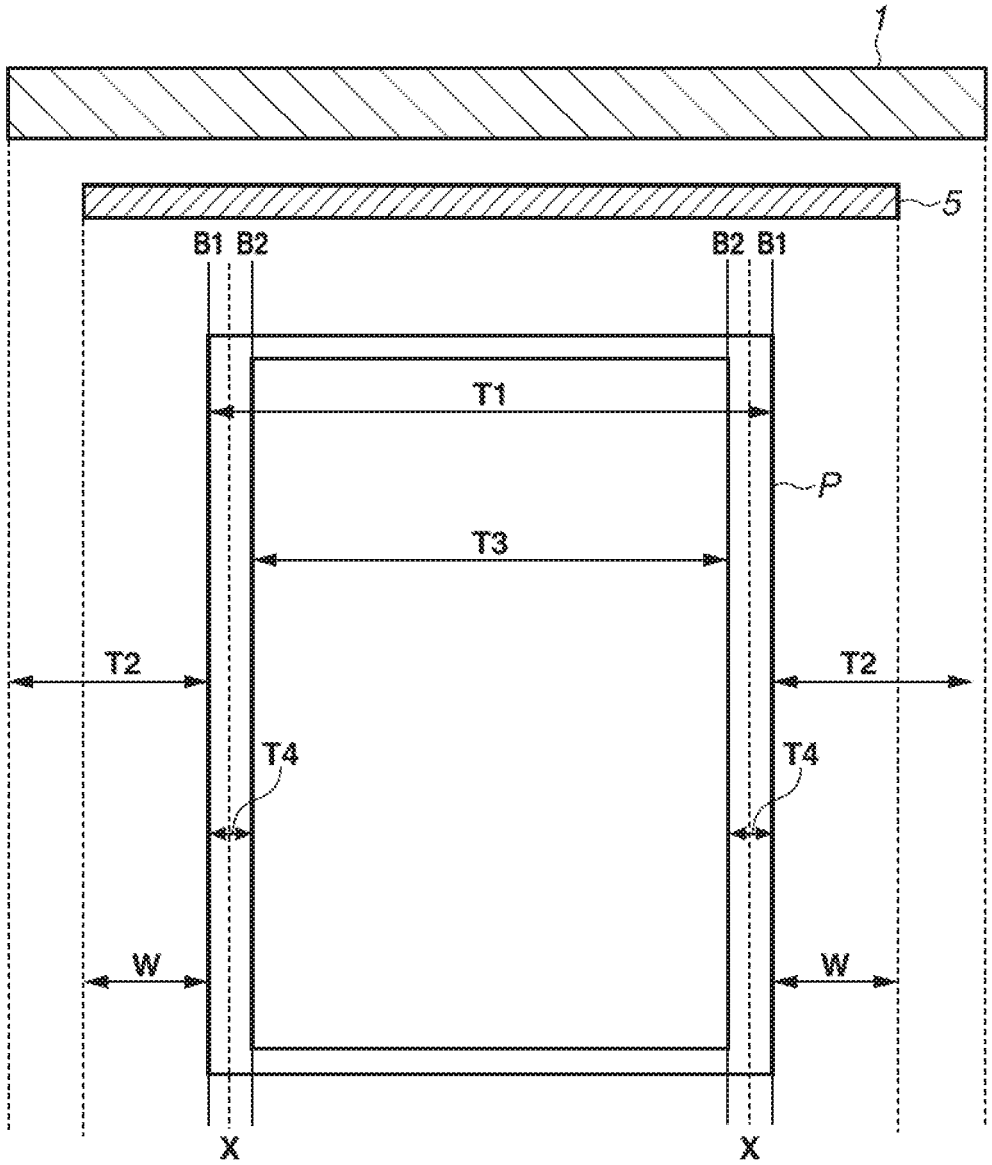
FIG. 3 is a detailed view of a recording medium according to the first exemplary embodiment.

A recording medium P chosen by the user is fed into the sheet feeding cassette 7, and conveyed to the transfer nip portion Nt. The positional relationship between the photosensitive drum 1 and the transfer roller 5 related to the recording medium P when the recording medium P is conveyed to the transfer nip portion Nt will be described with reference to FIG. 3. FIG. 3 is a view of the recording medium P in the longitudinal direction thereof when the recording medium P is nipped between the photosensitive drum 1 and the transfer roller 5 at the transfer nip portion Nt. A portion where the recording medium P comes into contact with the photosensitive drum 1 at the transfer nip portion Nt is referred to as a sheet-passing portion T1. A portion where the recording medium P does not come into contact with the photosensitive drum 1 is referred to as a non-sheet-passing portion T2. Boundaries between the sheet-passing portion T1 and the non-sheet-passing portion T2 are referred to as sheet edges B1. A region inside the sheet edges B1 where an image can be formed is indicated as an image forming region T3. Edges of the region are indicated as image forming edges B2, and regions between the sheet edges B1 and the image forming edges B2 are indicated as margin portions T4. Positions on the photosensitive drum 1 contacting the recording medium P corresponding to the respective positions are similarly indicated. For example, positions of the surface of the photosensitive drum 1 where the recording medium P is in contact with the photosensitive drum 1 at the sheet edges B1 of the recording medium P are indicated as B1. In the present exemplary embodiment, each of the margin portions T4 is 4 mm. The rubber length of the transfer roller 5 in the longitudinal (i.e., rotational axis) direction is 216 mm assuming image formation up to the short side (i.e., direction perpendicular to the conveyance direction of the recording medium P) width of letter size (i.e., 215.9 mm), which is the maximum in the image forming apparatus 100.

During image formation, a voltage having a positive polarity opposite to the charge of the toner is applied as a transfer voltage, and a constant current circuit (not illustrated) controls the current that flows from the transfer roller 5 to the photosensitive drum 1 to be 3 μA for the letter size sheet width. When the sheet width is significantly smaller than the longitudinal width of the transfer roller 5, a current flows into the photosensitive drum 1 in the non-sheet-passing portion T2. Thus, constant voltage control may be performed. The constant voltage value is determined based on the voltage generated when the transfer voltage is controlled such that a current flowing into the transfer roller 5 becomes a predetermined current by measuring the current at the timing when the surface potential of the photosensitive drum 1 becomes stable at the pre-rotation before image formation. The transfer voltage control is called an Active Transfer Voltage Control (ATVC), and the ATVC aims to obtain a good image by applying a transfer voltage suitable for dealing with variations in resistance values of the transfer roller 5 due to individual differences, environmental variations, and durability variations.

Figure 4:
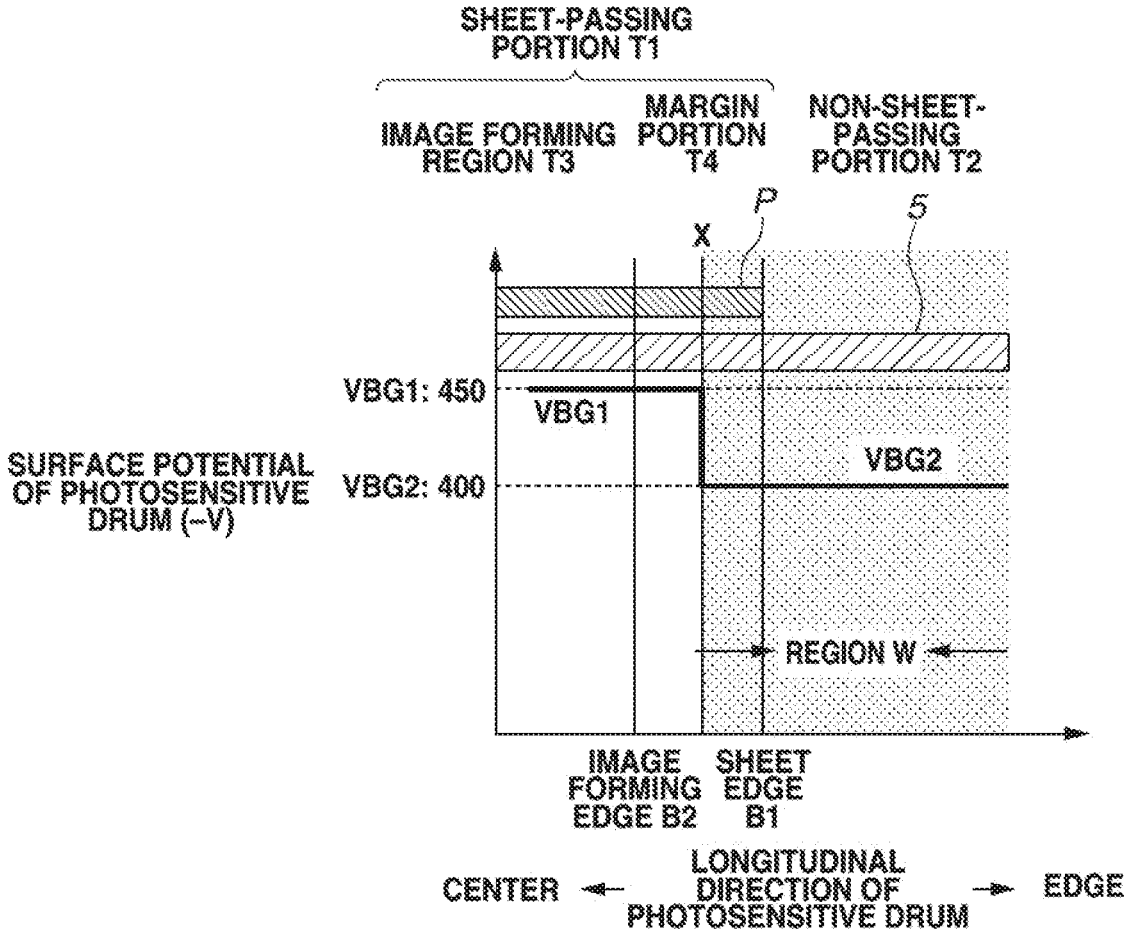
FIG. 4 is a diagram schematically illustrating a surface potential of a photosensitive drum during operation of the image forming apparatus according to the first exemplary embodiment.

FIG. 4 is a diagram schematically illustrating the surface potential of the photosensitive drum 1 during image forming operation according to the first exemplary embodiment.

In the present exemplary embodiment, the exposure amount and the exposure region of the photosensitive drum 1, which are charged to a uniform charging potential Vd (i.e., dark-portion potential: −460 V) by the charging roller 2 to which a charging voltage of about −1000 V is applied, are determined depending on an image signal and the size of the recording medium P. The image forming portion is exposed by the exposure unit 3 and adjusted to a post-exposure potential VL (i.e., light-portion potential: −100 V), which is a potential of the image portion. In a region in which no image is formed (i.e., background region) in the image forming region T3, the non-image portion is exposed with a first non-image exposure amount, and is adjusted to have a post-exposure potential VBG1 (i.e., background potential: −450 V), which is a non-image portion potential. A developing voltage Vdc (i.e., development potential: −300 V) is applied to the developing roller 4*a*, which develops the toner image with respect to the post-exposure potential VL on the photosensitive drum 1.

That is, the contrast between the surface potential Vd of the image forming portion on the photosensitive drum 1 and the development potential Vdc is 200 V, and the back contrast between the surface potential Vd and the background potential VBG1 on the photosensitive drum 1 is 150 V. This makes it possible to appropriately output an image such as a solid black image, a halftone image, and an outline character.

In the present exemplary embodiment, the exposure amount is adjusted by the control unit 202, as described below, with respect to the center line X (i.e., 2 mm from both of the imaging edge and the sheet edge B1) that equally divides the margin portion T4 between the sheet edge B1 and the image forming edge B2 illustrated in FIGS. 3 and 4. On the surface of the photosensitive drum 1 contacting the recording medium P, a region on the outer side with respect to the center line X and inside the longitudinal edge of the region where the transfer roller 5 and the photosensitive drum 1 are in contact with each other at the transfer nip portion Nt is indicated as a region W. The region W is exposed with a second non-image exposure amount that is an exposure amount larger than the first non-image exposure amount, and is adjusted to a post-exposure potential VBG2 (−400 V).

3. Transfer Current at Sheet Edge

Figure 5:
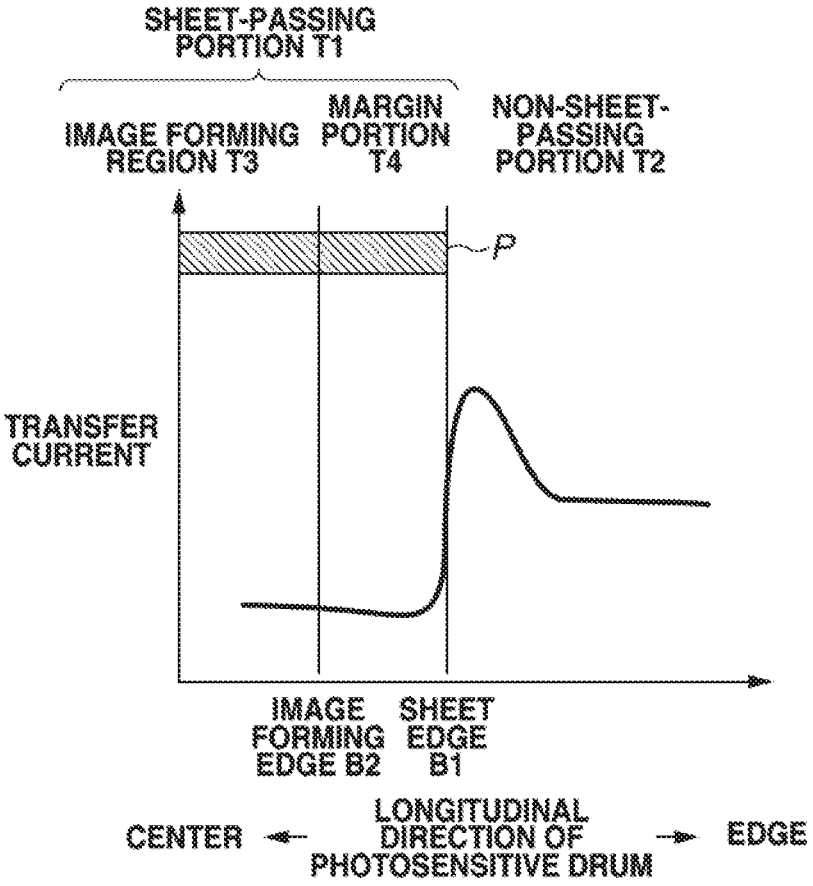
FIG. 5 is a diagram illustrating an assumed current flowing into the photosensitive drum when a transfer voltage is applied according to the first exemplary embodiment.
Figure 6:
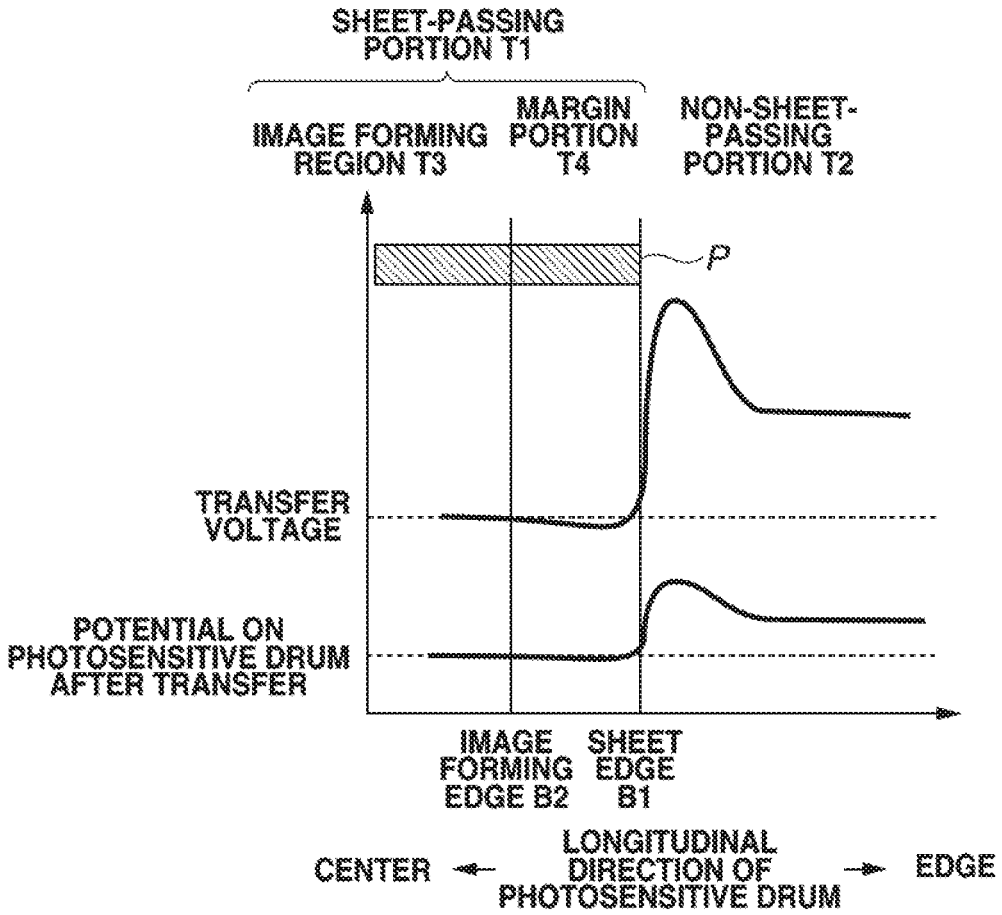
FIG. 6 is a relationship diagram illustrating the transfer voltage applied to the photosensitive drum and the surface potential after transfer according to the first exemplary embodiment.

A transfer current for transferring an image on the photosensitive drum 1 to the recording medium P will be described. FIG. 5 is a diagram illustrating a flow of a transfer current during transfer of the toner image on the photosensitive drum 1 to the recording medium P at the transfer nip portion Nt. As illustrated in FIG. 5, a transfer current for appropriately transferring the toner image flows through the image forming region T3 of the recording medium P, so that a necessary potential difference is formed. On the other hand, at the sheet edge B1 of the recording medium P, a current that would flow into the recording medium P flows into the contact portion between the transfer roller 5 and the photosensitive drum 1 in the non-sheet-passing portion T2 with which the recording medium P does not come into contact. The current flow is caused by the difference in resistance between the recording medium P and the photosensitive drum 1. In a case where a recording medium P containing a large amount of filler and thus having a high resistance is used, when the recording medium P is used in a low humidity environment, the water content is lowered and thus the resistance value further increases. Such an increased resistance of the recording medium P may prevent proper flow of a current. As a result, at the sheet edge B1, which is the boundary between the sheet-passing portion T1 and the non-sheet-passing portion T2, over-discharge occurs due to excessive transfer current flowing into the non-sheet-passing portion T2, and the reverse discharge between the transfer roller 5 and the photosensitive drum 1 is accelerated. FIG. 6 illustrates the distribution of the surface potential of the photosensitive drum 1 in the longitudinal direction after the transfer current flows into the non-sheet-passing portion T2. Although the surface potential of the photosensitive drum 1 before transfer can be formed uniformly in the longitudinal direction from the non-sheet-passing portion T2 to the sheet-passing portion T1, the surface potential on the photosensitive drum 1 after transfer is biased. Specifically, the surface potential of the photosensitive drum 1 after transfer in the non-sheet-passing portion T2 has a smaller absolute value than that of the surface potential of the photosensitive drum 1 after transfer at the sheet-passing portion T1. In particular, in the sheet-passing portion T1 where the recording medium P is present, the voltage does not drop because the transfer current is difficult to flow due to the influence of the recording medium P. Thus, the voltage of the surface of the transfer roller 5 is always high. Therefore, the non-sheet-passing portion T2 close to the sheet-passing portion T1 is oppositely charged with strong discontinuous discharge.

Figure 7:
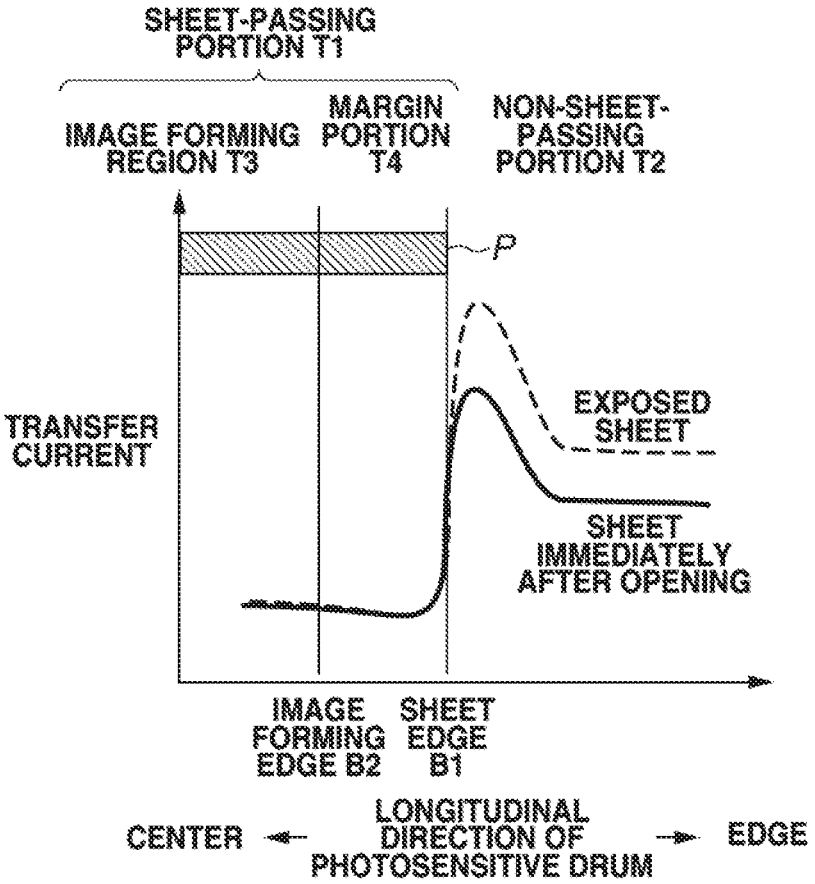
FIG. 7 is a diagram illustrating an assumed current that flows into the photosensitive drum when a transfer voltage is applied according to the first exemplary embodiment.

FIG. 7 illustrates the longitudinal distribution of the current value flowing through the photosensitive drum 1, which is assumed from the potential after transfer when the recording medium P is conveyed. A recording medium P immediately after opening the package (referred to as a sheet immediately after opening) is not affected by the environment and thus does not have an increased resistance. In general, the amounts of the transfer current flowing through the sheet-passing portion T1 and the non-sheet-passing portion T2 of the transfer roller 5 are different, and the current value at the non-sheet-passing portion T2 is larger, resulting in a current distribution as illustrated by the solid line in FIG. 7. In practice, a current flows laterally in the longitudinal direction of the transfer roller 5 at the sheet edge B1 to flow into the non-sheet-passing portion T2 where a current can flow more easily because no sheet is present. As a result, a large current flows near the sheet edge B1 on the side of non-sheet-passing portion T2.

On the other hand, a recording medium P that has been exposed to the environment for 48 hours (referred to as an exposed sheet) is affected to have an increased resistance value. In a case where the exposed sheet is used as the recording medium P, the transfer voltage is increased under the constant current control to maintain the transfer voltage density in the image forming portion. Thus, as illustrated in FIG. 7, the transfer current density of the image forming region T3 in the sheet-passing portion T1 is constant, but the current value of the non-sheet-passing portion T2 is remarkably increased.

Therefore, the current values flowing through the sheet-passing portion T1 and the non-sheet-passing portion T2 are different, so that excessive reverse discharge occurs in the non-sheet-passing portion T2. Since this phenomenon is affected by the resistance of the recording medium P, this phenomenon becomes remarkable when a sheet having a high resistance is used.

Figure 8:
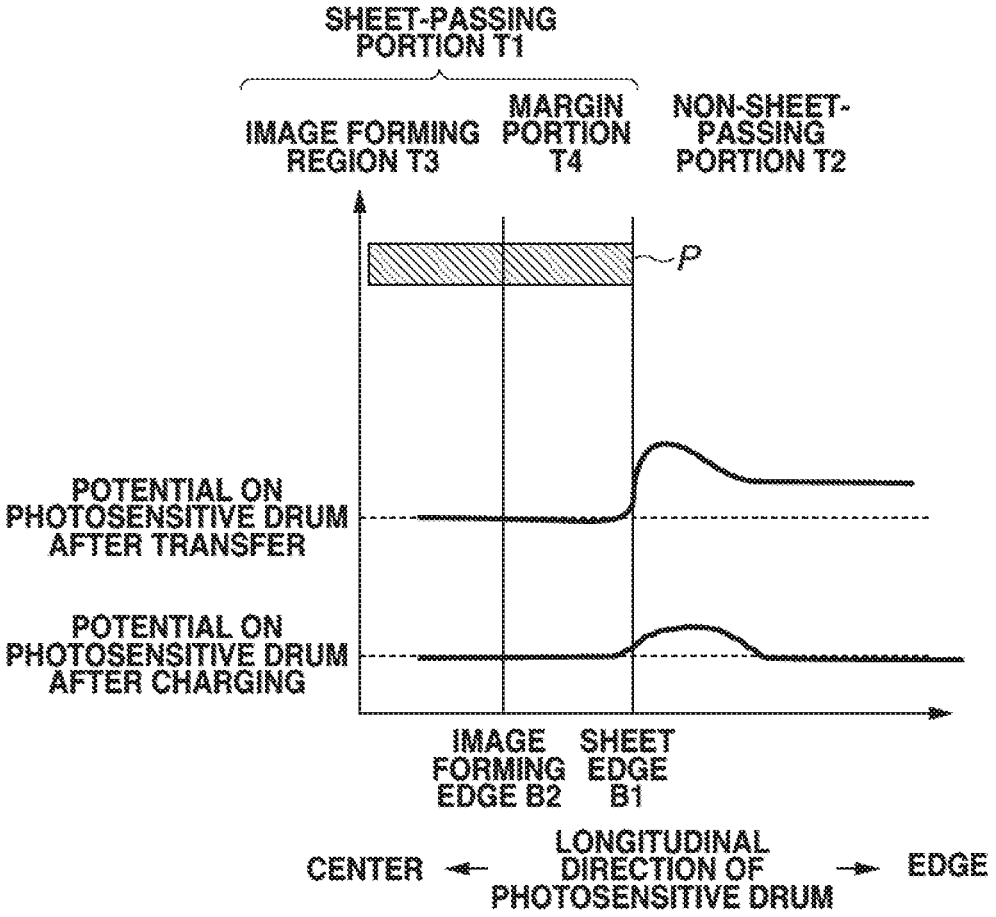
FIG. 8 is a relationship diagram illustrating the surface potential after transfer and the surface potential after charging of the photosensitive drum according to the first exemplary embodiment.

After transfer, on the surface of the photosensitive drum 1 in the non-sheet-passing portion T2, which has been oppositely charged, a surface potential is formed again by the charging roller 2 to form a next image. FIG. 8 illustrates the surface potential before and after charging of the photosensitive drum 1 in a case where the photosensitive drum 1 is oppositely charged strongly in the non-sheet-passing portion T2. Due to an effect of the opposite charging at the transfer nip portion Nt, the potential after the transfer does not become uniform, and the surface potential of the photosensitive drum 1 has a small absolute value in the non-sheet-passing portion T2. Due to the state in the non-sheet-passing portion T2, the surface potential of the photosensitive drum 1 after the charging does not reach a desired potential. Thus, fogging toner adheres to the photosensitive drum 1 in a developing process carried out by the developing roller 4*a*. As a result, the toner on the photosensitive drum 1 is transferred to the transfer roller 5 to soil an edge of the recording medium P near the region of the photosensitive drum 1 that is oppositely charged.

In the present exemplary embodiment, the surface potential of the photosensitive drum 1 on the sheet edge B1 at the boundary between the sheet-passing portion T1 and the non-sheet-passing portion T2 is made to have a smaller absolute value in advance than that of the surface potential of the photosensitive drum 1 formed in the image forming region T3, thereby preventing occurrence of over-discharge. Specifically, as illustrated in FIG. 4, in a region on the inner side in the longitudinal direction of the photosensitive drum 1 with respect to the position X between the image forming edge B2 and the sheet edge B1, the absolute value of the surface potential of the photosensitive drum 1 is adjusted to the surface potential at a time of image formation. On the other hand, in a region W on the outer side including the sheet edge B1, which is the boundary between the sheet-passing portion T1 and the non-sheet-passing portion T2, non-image exposure is performed, so that the surface potential of the photosensitive drum 1 is adjusted to an absolute value smaller than that in the image forming region T3. There is a concern about the difference in resistance due to the gradient of potential in the margin portion T4. However, since a sheet is present in this portion, the difference in resistance in the portion is caused only by the potential difference, so that the influence on the photosensitive drum 1 after transfer is small. Further, at the sheet edge B1, which is the boundary between the sheet-passing portion T1 and the non-sheet-passing portion T2, the absolute value of the surface potential on the photosensitive drum 1 is smaller than that in the sheet-passing portion T1, so that the potential difference (referred to as transfer contrast) between the surface potential of the photosensitive drum 1 and the transfer potential applied to the transfer roller 5 is smaller. Thus, excessive reverse discharge due to the transfer current flowing into the non-sheet-passing portion T2 can be suppressed, and the influence on the surface potential formation on the photosensitive drum 1 after the transfer and charging can be reduced. As illustrated in FIG. 4A, region on which the second non-image exposure is performed may include a region outside the transfer nip portion Nt with respect to the longitudinal edge in addition to the region W. Further, when the non-image exposure is performed, discharge is accelerated, and the surface layer of the photosensitive drum 1 may be scraped or deteriorated. In order to suppress the problem on the surface layer, the non-image exposure may not be performed on a region, in the region W, that is far from the boundary between the sheet-passing portion T1 and the non-sheet-passing portion T2 and that is not close to the sheet edge B1.

Figure 9:
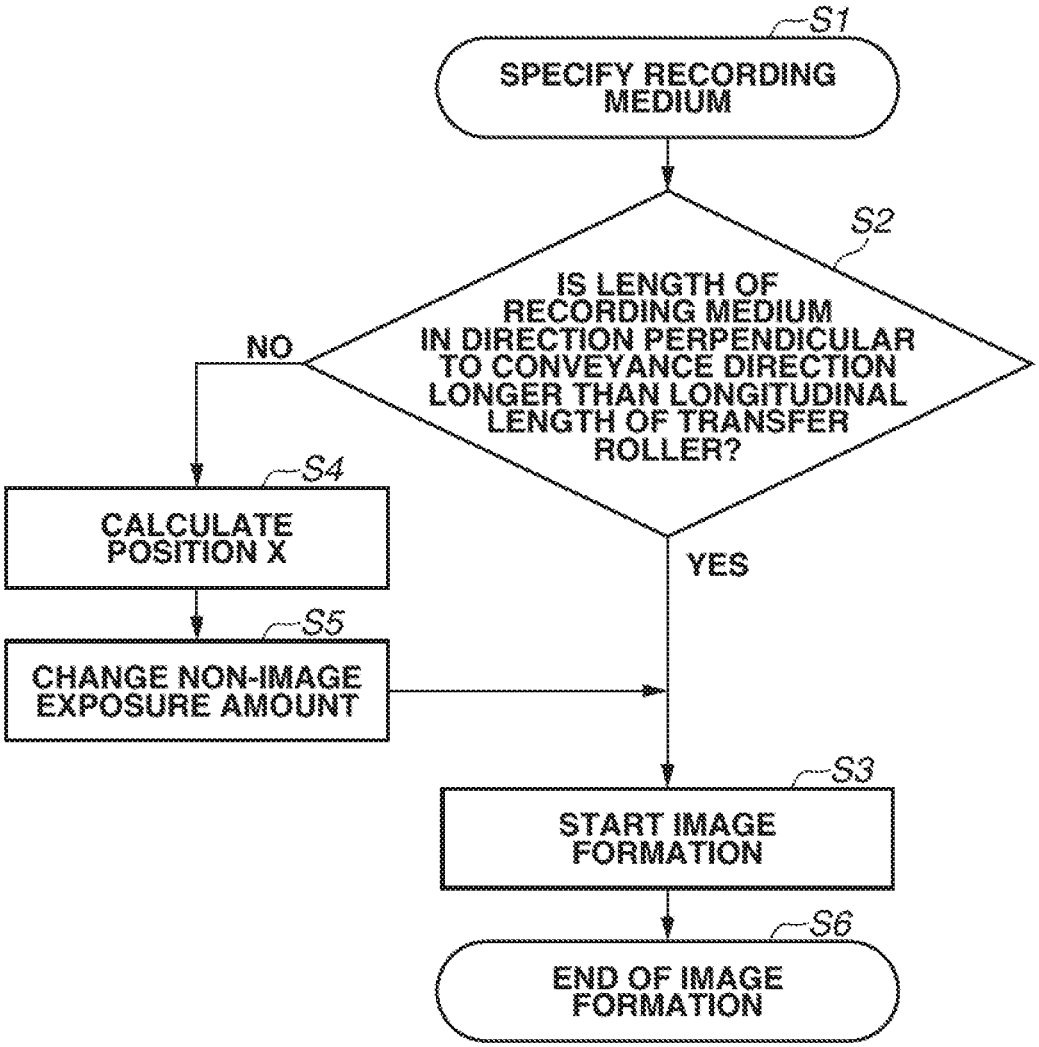
FIG. 9 is a flowchart illustrating the image forming operation according to the first exemplary embodiment.

An operation according to the present exemplary embodiment will be described with reference to a flowchart of FIG. 9.

First, prior to image formation, a recording medium P specified by a user is fed to the sheet feeding cassette 7 (step S1). The position of the longitudinal edge of the recording medium P is transmitted to the control unit 202 based on the size information of the recording medium P stored in advance in the memory 152 on the recording medium P specified by the user in step S1. The control unit 202 then determines, based on the information on the recording medium P, whether the length of the recording medium P in the direction perpendicular to the conveyance direction is longer than the longitudinal length of the transfer roller 5 (step S2). If the length of the recording medium P in the direction perpendicular to the conveyance direction is longer than the longitudinal length of the transfer roller 5 (Yes in step S2), the control according to the present exemplary embodiment is not necessary. Thus, image formation is performed (step S3) without performing the control. On the other hand, if the length of the recording medium P in the direction perpendicular to the conveyance direction is shorter than the longitudinal length of the transfer roller 5 (No in step S2), the control unit 202 performs the control to calculate the position X of the recording medium P (step S4), and change the non-image exposure amount at the position X (step S5). Then, the image forming operation starts (step S3). Then after the image formation on the recording medium P is completed, the recording medium P is discharged to the outside of the image forming apparatus 100 in a sheet conveying manner (step S6). Although in the present exemplary embodiment, the amount of light is changed at the position X, which is the center line of the region between the image forming edge B2 and the sheet edge B1, the present disclosure is not limited to this configuration as long as the flow of the transfer current into the non-sheet-passing portion T2 can be suppressed.

4. Confirmation of Effect of Present Exemplary Embodiment

In the present exemplary embodiment, in a region where the photosensitive drum 1 is in contact with the recording medium P and the region includes the sheet edge B1, which is the boundary between the sheet-passing portion T1 and the non-sheet-passing portion T2, the surface potential has a smaller absolute value than that of the surface potential of the photosensitive drum 1 formed in the image forming region T3 before the photosensitive drum 1 enters the transfer nip portion Nt. Thus, excessive reverse discharge due to the transfer current flowing into the non-sheet-passing portion 12 is suppressed.

An experiment to confirm an effect of the present exemplary embodiment was carried out.

Figure 10:
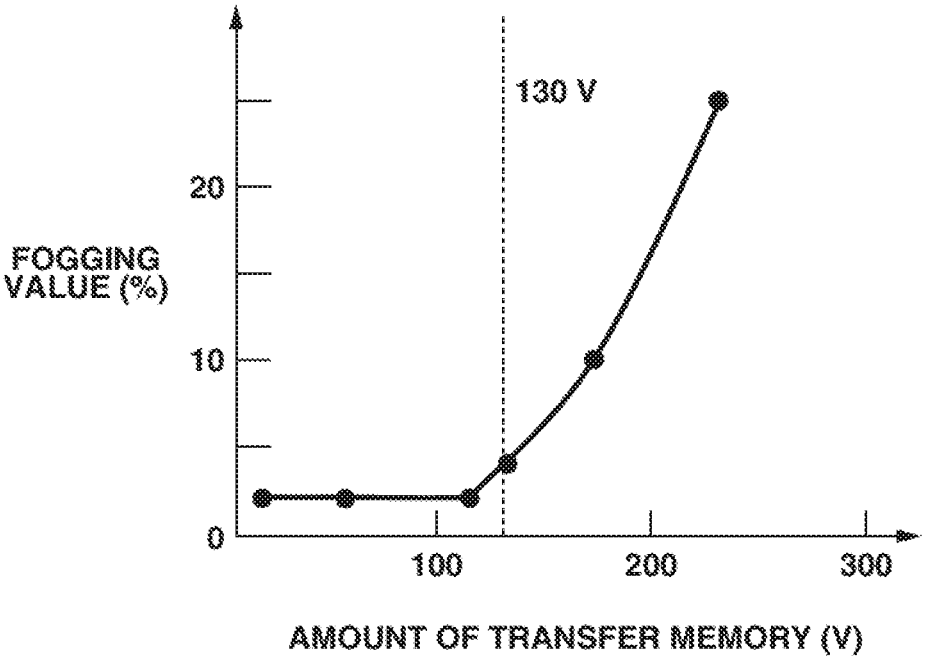
FIG. 10 is a diagram illustrating the relationship between an amount of transfer memory and fog on the photosensitive drum according to the first exemplary embodiment.

In the region of the non-sheet-passing portion T2, the photosensitive drum 1 receives a transfer current and reverse discharge occurs due to the transfer, and the surface potential of the photosensitive drum 1 after the transfer is not appropriate. Therefore, fogging, in which toner adheres to the surface of the photosensitive drum 1, occurs, which leads to soiling of the recording medium P. A preliminary experiment to confirm the relationship between the effect of transfer and fogging was carried out. FIG. 10 illustrates the relationship between the amount of transfer memory and the fogging value on the photosensitive drum 1. Both the fogging value and the amount of transfer memory will be described in detail.

In order to measure the fogging value, the toner on the photosensitive drum 1 was transferred onto a Mylar tape, the tape was put on a reference sheet, and then the density of the tonner on the Mylar tape was measured using a reflection density meter (TC-6DS/A) manufactured by Tokyo Denshoku Co., Ltd. The fogging value was calculated from the amount of toner on the photosensitive drum 1 when the image forming operation was performed using the image forming apparatus 100 and the image was developed by changing the transfer contrast without using a recording medium P.

The amount of transfer memory was determined by measuring the potential of the surface of the photosensitive drum 1 before and after the transfer roller 5 passed through by using a surface electrometer (MODEL 344) manufactured by TREK Co., Ltd. and calculating the difference between the potentials.

As illustrated in FIG. 10, when the amount of transfer memory increases, the fogging starts increasing at a certain threshold. It is considered that the increase occurs because the width of a region in the sheet conveyance direction where discharge can occur in the transfer nip portion Nt between the transfer roller 5 and the photosensitive drum 1, becomes larger, electric discharge is started between the transfer roller 5 and the photosensitive drum 1 by a large space distance, and thus discontinuous and strong discharge occurs. The electric discharge becomes larger as the transfer contrast increases.

The discharge occurring here is discontinuous strong discharge, and has a large potential of a polarity opposite to the polarity of the toner. It is considered that the discontinuous strong discharge causes attraction of the toner at the developing unit 4 to generate the fogging, and makes the photosensitive drum 1 have the surface potential that changes greatly in a circumferential direction or a longitudinal direction to generate a winding electric field. Thus, the fogging in a spot shape occurs.

The amount of the transfer memory described above is measured by macroscopically capturing a surface potential. As illustrated in FIG. 10, it is clear that when the amount of the transfer memory calculated from the result exceeds approximately 130 V, the tonner is developed as the fogging.

Next, the effect of the present exemplary embodiment will be described. The effect is achieved by suppression of the excessive reverse discharge caused by the transfer current flowing into the non-sheet-passing portion T2 and then by suppression of the edge soiling of the recording medium P. In order to confirm the effect, CS-520 manufactured by Canon Inc. of A4 size (hereinafter referred to as A4 sheet) was used as the recording medium P. The effect was confirmed under low-temperature of 15° C. and low-humidity environment of 10% as a condition for increasing the resistance of the recording medium P. Exposed sheets, which were left in the environment for 48 hours after opening of the package, was prepared, 200 sheets were passed to print an image with a printing ratio of 4%, and the edge soiling of the recording media P after the passing were compared. In order to confirm the effect of the present exemplary embodiment, in Example 1, the surface potential of the photosensitive drum 1 was adjusted such that VBD1=−450 V and VBD2=−400 V as illustrated in FIG. 4. In Comparative Example 1, the surface potential was adjusted such that VBD1=−450 V and VBD2=−450 V to carry out an effect comparison experiment.

Table 1 lists the state of the edge soiling of the recording medium P, the amount of the transfer memory on the edge (refer to the amount of the edge transfer memory), and the edge current calculated from the amount of the edge transfer memory. The amount of the edge transfer memory was calculated by measuring the potential of the photosensitive drum 1 at the non-sheet-passing portion T2 near the sheet edge B1 in a manner similar to the preliminary experiment. In addition, the amount of the edge current was calculated by considering the electrostatic capacitance of the photosensitive drum 1 based on the calculated amount of the edge transfer memory and assuming that the transfer current flowed into the entire area in the longitudinal direction of the transfer roller 5.

TABLE 1

| | Soiling of Recording Medium | Amount of Edge Transfer Memory (V) | Edge Current Amount (μA) |
|---|---|---|---|
| Comparative Example 1 | Occurred | 141 | 8.1 |
| Example 1 | Did Not Occur | 108 | 6.2 |

As listed in Table 1, in Comparative Example 1, the soiling at the edge of the recording medium P was confirmed. At this time, the current flowing into the sheet at the sheet edge B1 exceeds a transfer memory threshold value acquired from the preliminary experiment, and the current value at the edge is larger than the value 7.5 μA calculated by converting the transfer memory threshold value (i.e., 130 V). It is considered that, this lowers the surface potential of the photosensitive drum 1 due to the transfer memory at the sheet edge B1 of the photosensitive drum 1, and fogging occurs at a portion that is not charged properly, resulting in the soiling at the edge of the recording medium P.

On the other hand, in Example 1, the recording medium P was not soiled. At this time, the current flowing into the sheet at the sheet edge B1 is suppressed to be lower than 7.5 μA, which is the transfer memory threshold acquired from the preliminary experiment. It is considered that, lowering of the surface potential of the photosensitive drum 1 due to the transfer memory at the sheet edge B1 of the photosensitive drum 1 is suppressed, and thus occurrence of the fogging is suppressed, resulting in suppression of the soiling at the end of the recording medium P. Results of Example 1 will be discussed.

Figure 11:
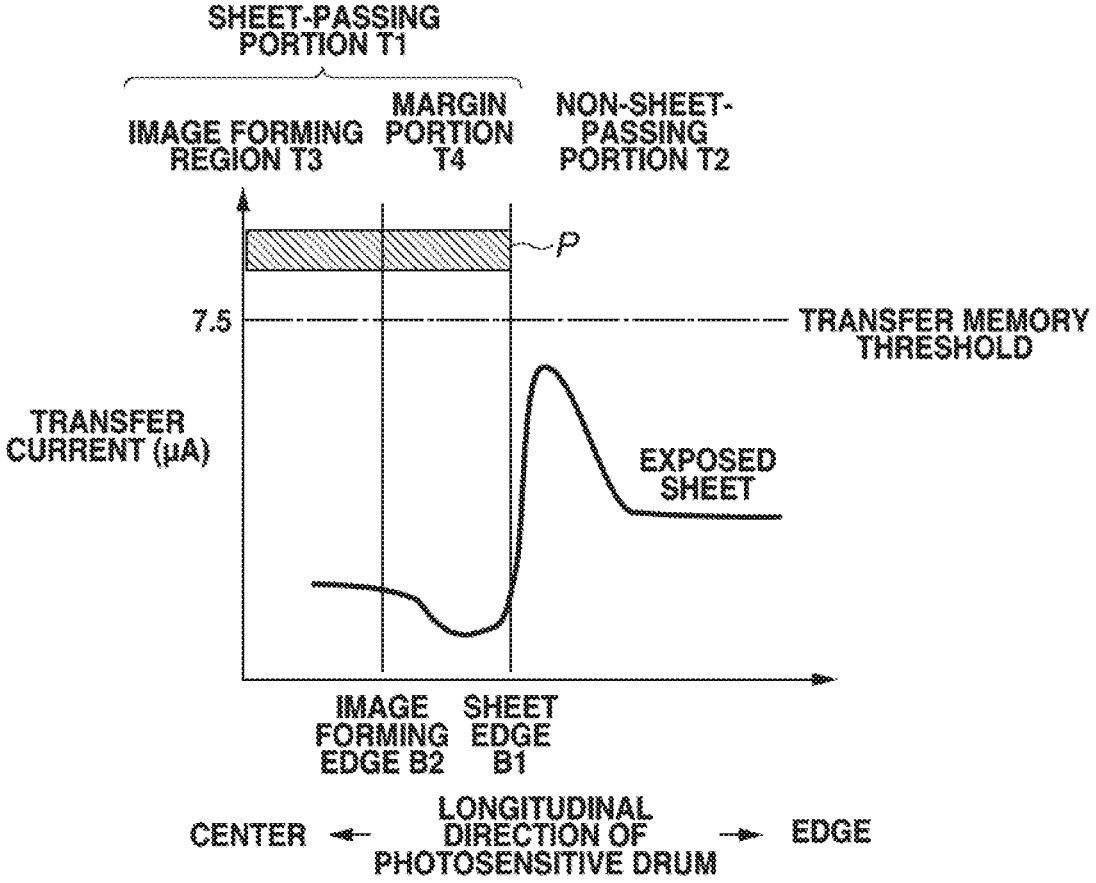
FIG. 11 is a diagram of an assumed current flowing into the photosensitive drum when the transfer voltage is applied according to the first exemplary embodiment.

FIG. 11 illustrates the longitudinal distribution of the current value flowing through the photosensitive drum 1, which is assumed from the potential after the transfer in Example 1. In Example 1, the surface potential of the photosensitive drum 1 at the sheet edge B1 has a smaller absolute value than that of Comparative Example 1. Thus, the transfer contrast, which is a difference from the transfer voltage applied to the transfer roller 5, becomes smaller. The reduced current flowing into the non-sheet-passing portion T2 reduces the current at the sheet edge B1, and as a result, the amount of the transfer memory is reduced. Thus, it is considered that the reduction suppresses occurrence of the soiling on the recording medium P. Based on the mechanism, the experiment to confirm the effect was carried out by using the configuration of Example 1. As a result, it was confirmed that the amount of the transfer memory can be reduced and the soiling on the recording medium P can be suppressed even if the exposed sheet having a high resistance is used.

In order to suppress the soiling of the recording medium P as described above, in the present exemplary embodiment, control is performed as described below.

Out of the region of the photosensitive drum 1 forming the transfer nip portion Nt, a region where a toner image can be formed is defined as a first region, and a region where the recording medium P does not pass when the recording medium P is conveyed by the transfer nip portion Nt is defined as a second region. When a toner image is formed on the recording medium P, control is performed such that the photosensitive drum 1 enters the transfer nip portion Nt in a state where the second region includes a region in which the absolute value of the surface potential is smaller than that in the region in which the toner image is not formed in the first region. Alternatively, control may be performed such that the photosensitive drum 1 enters the transfer nip portion Nt in a state where the surface potential of the second region has a smaller absolute value than that of the surface potential of the photosensitive drum 1 formed in the region where the toner image is not formed in the first region.

In Example 1, the exposure amount of the exposure unit 3 is controlled as follows.

The exposure unit 3 performs first exposure to form a potential to not form a toner image on the photosensitive drum 1 charged by the charging roller 2. On the other hand, the exposure unit 3 performs a second exposure with an exposure amount that is larger than the exposure amount of the first exposure and that is necessary for forming the potential to form the toner image. Thereby, an electrostatic latent image is formed on the surface of the photosensitive drum 1. When a toner image is formed on the recording medium P, the exposure amount is controlled such that the second region includes a region where the exposure amount when the first exposure is performed on the second region, is larger than that of the first region to adjust the surface potential of the photosensitive drum 1 entering the transfer nip portion Nt.

In this way, by adjusting the exposure amount and the exposure region depending on the size of the recording medium P and adjusting the surface potential of the photosensitive drum 1 at the sheet edge B1, the transfer contrast at the transfer portion can be reduced, and the reverse discharge to the non-sheet-passing portion T2 can be suppressed. As a result, the transfer memory can be reduced and the soiling at the sheet edge B1 of the recording medium P is suppressed.

Although the soiling at the sheet edge B1 of the recording medium P can be suppressed by performing control such that the above relationship is satisfied, it is preferable to control the surface potential in the transfer nip portion Nt between the photosensitive drum 1 and the transfer roller 5 at the non-sheet-passing portion T2 from the viewpoints described below. It is not necessary to adjust the surface potential in advance near the transfer roller edge of the transfer nip portion Nt between the photosensitive drum 1 the transfer roller 5 in the non-sheet-passing portion T2. This is because the region near the transfer roller edge does not contribute to the lateral flow of the transfer current, and therefore, the region may have a surface potential which matches that of the image forming region T3 without carrying out exposure.

Figure 12:
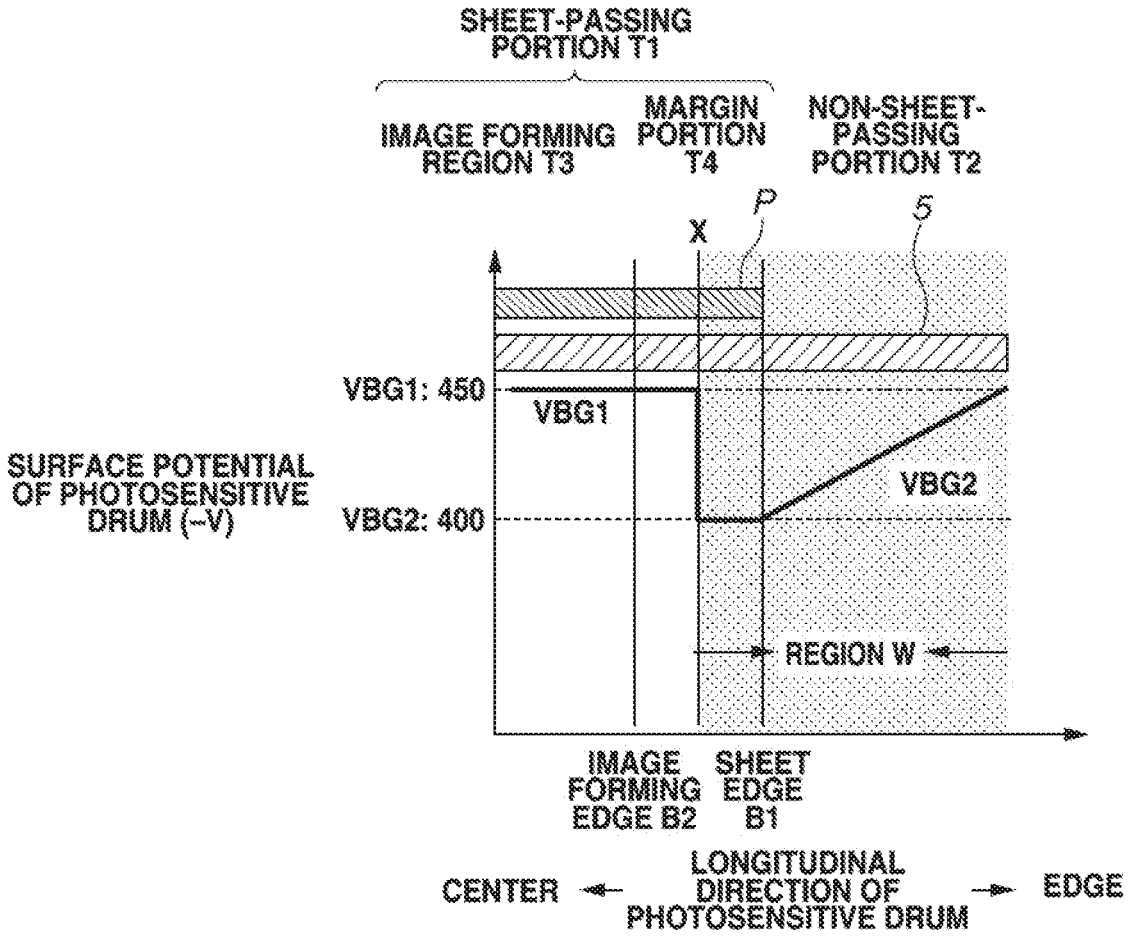
FIG. 12 is a diagram schematically illustrating the surface potential of the photosensitive drum during operation of the image forming apparatus according to the first exemplary embodiment.
Figure 13:
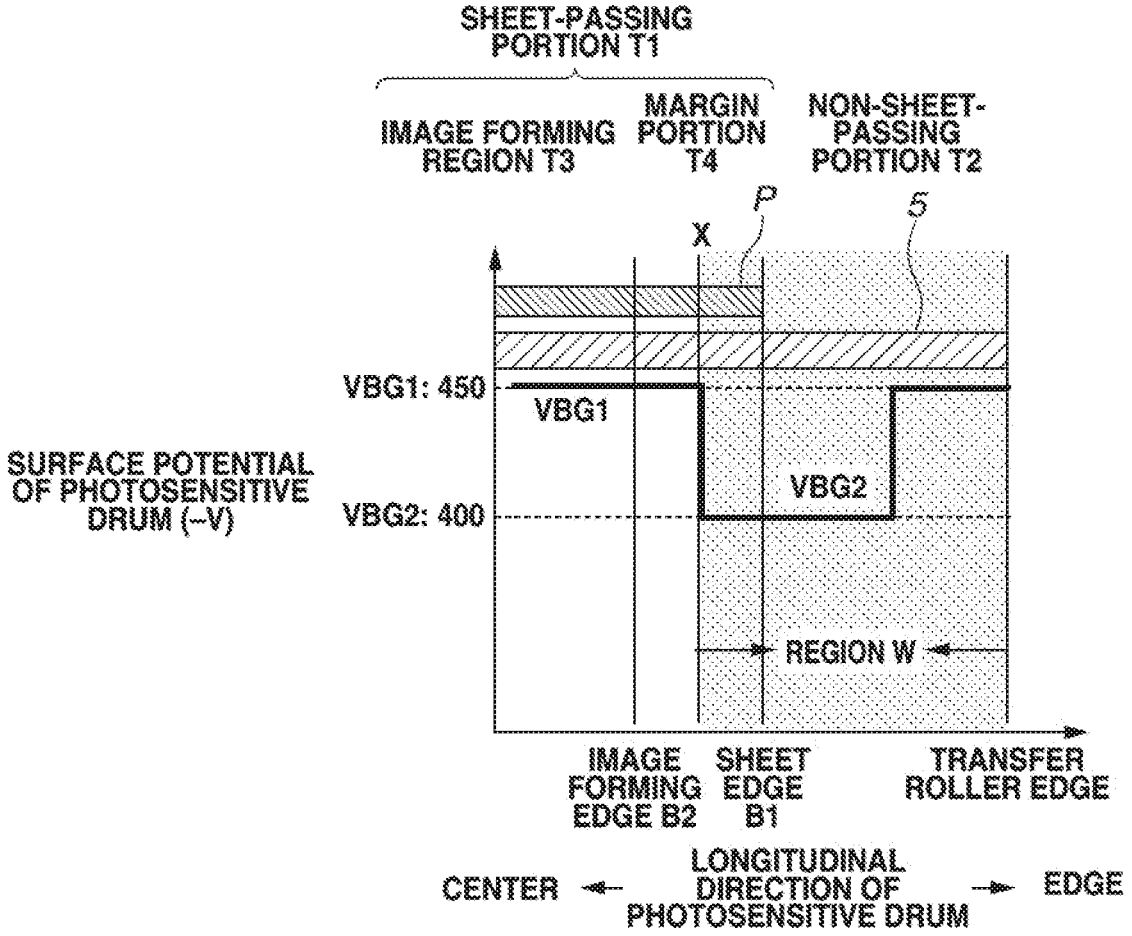
FIG. 13 is a diagram schematically illustrating the surface potential of the photosensitive drum during operation of the image forming apparatus according to the first exemplary embodiment.

Thus, the exposure region of the non-sheet-passing portion T2 does not have to be the entire length, and it is sufficient if the effect of the lateral flow of transfer current from the sheet edge B1 is eliminated. For example, the surface potential may be gradually changed toward the edge of the transfer roller 5 as illustrated in FIG. 12, or the surface potential may be changed from a region where no lateral flow of the transfer current occurs as illustrated in FIG. 13. As an example, the photosensitive drum 1 may be exposed in a region between the sheet edge B1 that is in contact with the photosensitive drum 1 and the edge of the transfer roller 5, and where the transfer current does not flow laterally from the sheet edge B1.

In other words, when the toner image is formed on the recording medium P, control is performed such that the photosensitive drum 1 enters the transfer nip portion Nt in a state where the absolute value of the surface potential gradually increases toward the outside in the rotational axis direction of the photosensitive drum 1 in the second region. Here, the region of the photosensitive drum 1 between the first region and the second region is defined as a third region. It is preferable that the photosensitive drum 1 enter the transfer nip portion Nt in a state where the second region includes a region in which the absolute value of the surface potential is larger than that of the third region. Further, control may be performed such that the photosensitive drum 1 enters the transfer nip portion Nt in a state where the surface potential of a region on the outer side in the rotational axis direction of the photosensitive drum 1 in the second region has the same absolute value as that of the region where the toner image is not formed in the first region. This control may suppress the discharge.

Although, in the first exemplary embodiment, exposure is performed also on the non-image portion of the image forming region T3 by the exposure unit 3, this exposure is not necessary.

Although, in the present exemplary embodiment, the recording medium P is directly conveyed to the transfer nip portion Nt between the photosensitive drum 1 and the transfer roller 5, a belt-shaped conveyance member that is in contact with the photosensitive drum 1 and conveys the recording medium P may be used.

The thickness of the rubber portion of the transfer roller 5 of about 4 mm or more is suitable for the present exemplary embodiment.

The exposure amount in the exposure region of the non-sheet-passing portion T2 and the surface potential of the photosensitive drum 1 formed by the exposure are not limited to those described above. For example, when the resistance of the transfer roller 5 is high due to an environmental change or the like, the current flowing at the sheet edge B1 is reduced, whereby the amount of the transfer memory is reduced. In this case, the exposure amount may be reduced, or the absolute value of the surface potential of the photosensitive drum 1 may be increased. In a case where a resistance measuring unit (not illustrated) that measures the electrical resistance of the transfer roller 5 is provided, the surface potential of the photosensitive drum 1 may be changed based on the measurement result of the resistance of the transfer roller 5 acquired by the resistance measuring unit. Alternatively, a detection unit can be used as a temperature and humidity sensor that detects temperature and humidity, and the surface potential of the photosensitive drum 1 may be changed based on the information acquired by the detection unit.

In a case where means for calculating the resistance value of the recording medium P is provided, the resistance value can be used for the control. For example, when the calculated resistance value is low, the current convergently flowing into the sheet edge B1 is reduced, and thus the control unit 202 can determine in advance that the transfer memory amount will be reduced. In this case, the exposure amount may be reduced in advance, or the absolute value of the surface potential of the photosensitive drum 1 may be increased. In other words, in a case where a second resistance measuring unit (not illustrated) that measures the electrical resistance of the recording medium P is provided, the surface potential of the photosensitive drum 1 may be changed based on the measurement result of the resistance of the recording medium P acquired by the second resistance measuring unit.

The surface potential of the photosensitive drum 1 may be changed by changing the sensitivity of the photosensitive drum 1. For example, the discharge amount at the time of applying a voltage to the photosensitive drum 1 and the exposure sensitivity can be varied by changing the thickness of the photosensitive material. Thus, by adjusting the thickness of the photosensitive material in advance depending on the sheet size, a similar effect can be obtained.

Figure 14:
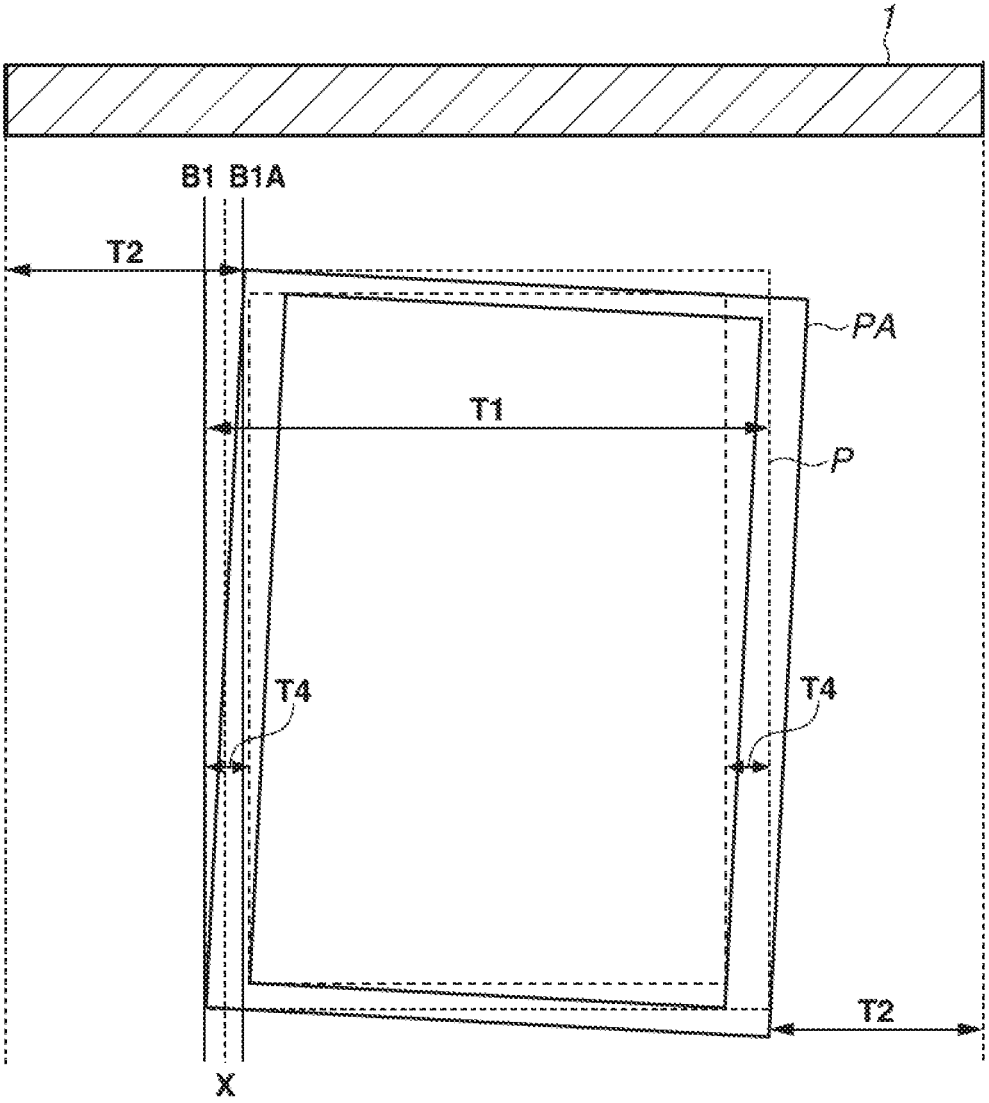
FIG. 14 is a detailed view of a recording medium according to a second exemplary embodiment.

In the first exemplary embodiment, when a sheet having a size that is specified by a user is used and sheet conveyance is performed properly, the surface potential of the photosensitive drum 1 at the sheet edge B1 is adjusted to reduce the transfer contrast at the transfer nip portion Nt, thereby suppressing soiling of the sheet edge B1 of the recording medium P. A second exemplary embodiment handles a case where the size of a recording medium P used by a user is different from the specified size of a recording medium P, and a case where a recording medium P conveyed to the transfer nip portion Nt is skewed as illustrated in FIG. 14 for example. The recording medium used in the cases is referred to as a recording medium PA. The second exemplary embodiment has a configuration for handling the case where an actual sheet edge B1A moves toward the center in the longitudinal direction of the photosensitive drum 1 compared to the sheet edge B1 assumed as a design center position. In a case where the design center value of the edge position of the recording medium P in the direction perpendicular to the sheet conveyance direction is defined as 0 mm, skew with deviation of the position of the sheet edge B1 within ±4 mm from the center position or a size mismatch within ±4 mm is accepted. Then, image forming operation is carried out without performing any control. On the other hand, in a case where deviation caused by skew or size mismatch exceeds ±4 mm, a driving source (not illustrated) of the image forming apparatus 100 is forcibly stopped and notifies a user.

Figure 15:
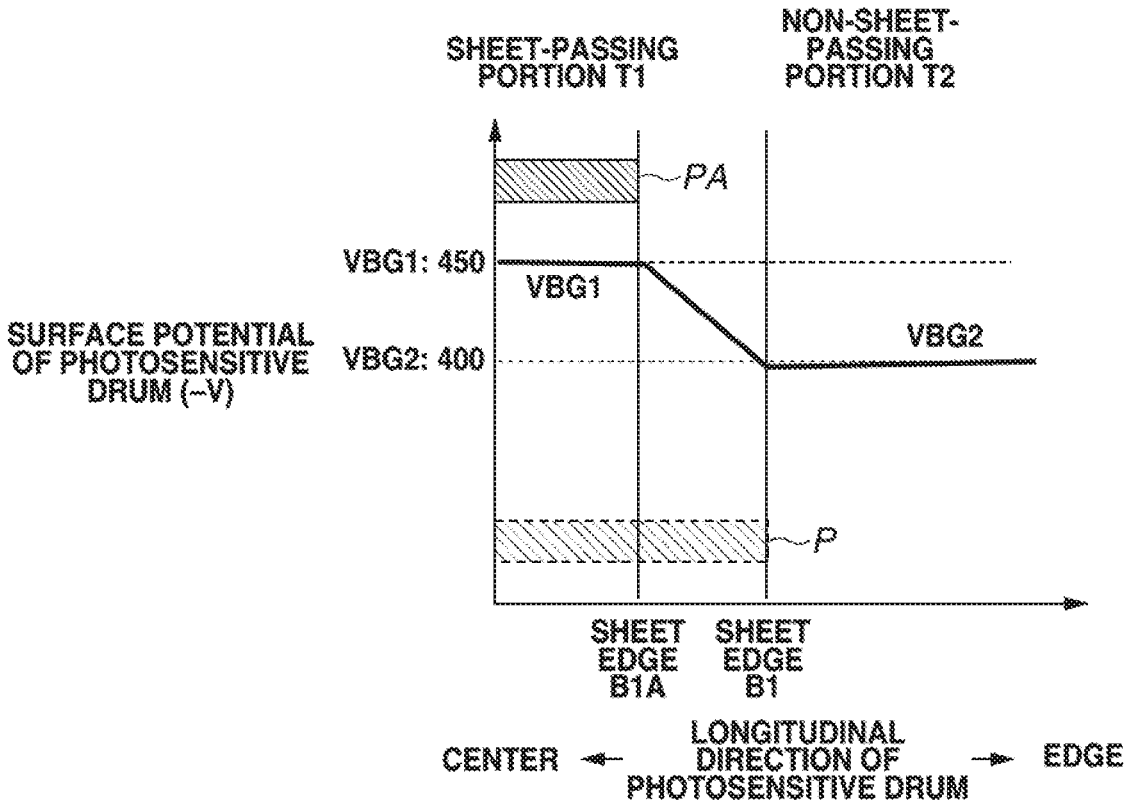
FIG. 15 is a diagram schematically illustrating a surface potential of a photosensitive drum during operation of an image forming apparatus according to the second exemplary embodiment.

Since configuration of an image forming apparatus 100 is the same as that of the first exemplary embodiment, the description thereof will not be provided. The difference from the first exemplary embodiment is a state of formation of the surface potential of the photosensitive drum 1 in contact with the region of the margin portion T4 in normal sheet conveyance. As illustrated in FIG. 15, in the second exemplary embodiment, the exposure amount of the exposure unit 3 is adjusted such that the surface potential continuously changes at a position on the photosensitive drum 1, which is in contact with the margin portion T4 in normal sheet conveyance. The potentials VBG1 and VBG2 are set to the same values as those in the first exemplary embodiment, and the exposure amount is linearly changed between VBG1 and VBG2 to make gradient on the surface potential.

Next, the effect of the present exemplary embodiment is described.

Assuming that the skew and size mismatch occur, the A4 sheet used in Example 1 was cut to reduce the longitudinal length of 210 mm to 202 mm, and the soiling on the recording medium PA after 200 exposed sheets have passed was evaluated in a similar manner to the Example 1. In Comparative Example 2, all experimental conditions other than the short side length of the recording medium PA are the same as those in Comparative Example 1. The results are listed in Table 2.

TABLE 2

| | Soiling of Recording Medium | Amount of Edge Transfer Memory (V) | Edge Current Amount (μA) |
|---|---|---|---|
| Comparative Example 2 | Significantly Occurred | 249 | 14.3 |
| Example 2 | Did Not Occur | 125 | 7.2 |

Figure 16:
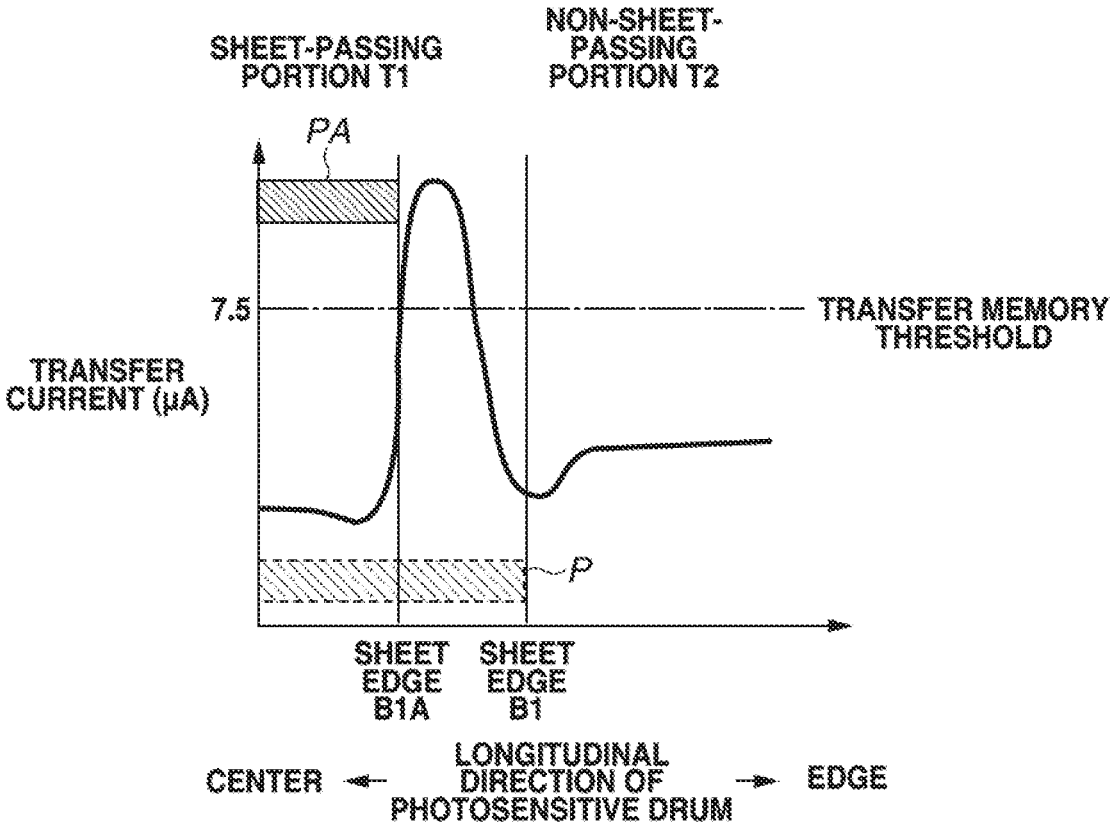
FIG. 16 is a diagram of an assumed current that flows into the photosensitive drum when a transfer voltage is applied according to a second comparative example.
Figure 17:
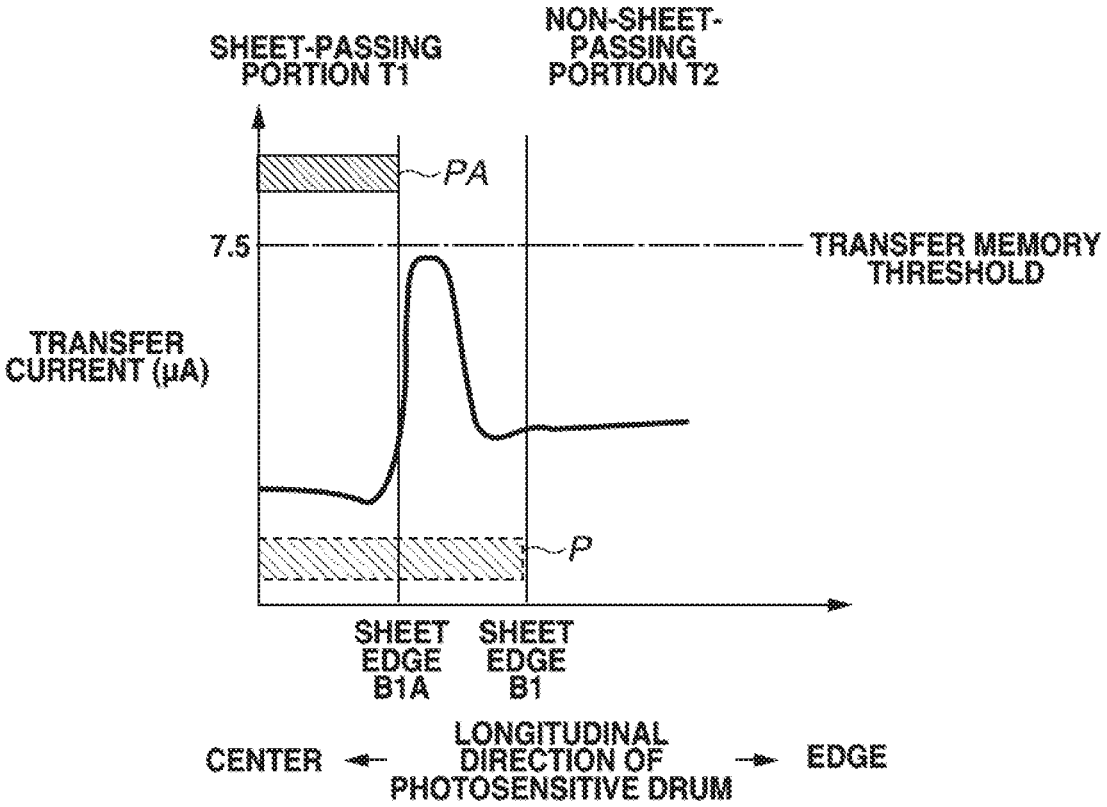
FIG. 17 is a diagram of an assumed current that flows into the photosensitive drum when the transfer voltage is applied according to the second exemplary embodiment.

In Comparative Example 2, the soiling occurred significantly at the edge of the recording medium PA when an exposed sheet is used. However, in Example 2, the soiling occurrence on the recording medium PA was suppressed. When the amounts of transfer memory and the amounts of current flowing into the non-sheet-passing portion T2 were compared between Comparative Example 2 and Example 2, it was confirmed that the amount of transfer memory and the amount of current flowing into the non-sheet-passing portion T2 were significantly reduced in the Example 2 compared to Comparative Example 2. FIG. 16 and FIG. 17 illustrate the longitudinal distribution of the current value flowing through the photosensitive drum 1, which is estimated from the post-transfer potential of the exposed sheet when the position of the sheet edge B1 is deviated to the position B1A. Further, FIG. 16 and FIG. 17 illustrate a case of Comparative Example 2 and a case of Example 2 respectively.

In Comparative Example 2 illustrated in FIG. 16, a region in which the transfer contrast is large exists at the sheet edge B1A position. Thus, a transfer current flows strongly into the non-sheet-passing portion T2. Further, a region including the non-sheet-passing portion T2 exists also inside the boundary X of the non-image exposure amount. Thus, a winding electric field is generated on the photosensitive drum 1, and as a result, a transfer current that is even stronger flows into the non-sheet-passing portion T2.

On the other hand, in Example 2 illustrated in FIG. 17, the surface potential of the photosensitive drum 1 is continuously changed in the region of the margin portion T4 in normal sheet conveyance as illustrated in FIG. 15. The range of the margin portion T4 is set such that the sheet edge B1A is within the margin portion T4 on the assumption of the skew and size mismatch of the recording medium PA, and there is no point at which the surface potential of the photosensitive drum 1 abruptly changes in the range. This makes it possible to make a state where there is no region where the absolute value of the surface potential of the photosensitive drum 1 is large even if the non-sheet-passing portion T2, which is a region on the outer side with respect to the sheet edge B A, enters the margin portion T4 in normal sheet conveyance. Further, the surface potential of the photosensitive drum 1 is set such that the absolute value of the surface potential becomes smaller from the image forming edge B2 toward the sheet edge B1 in normal sheet conveyance. As a result, the non-sheet-passing portion T2 always exists on the outer side with respect to the region in which the surface potential of the photosensitive drum 1 is changed, and the absolute value of the surface potential of the photosensitive drum 1 becomes relatively small in a region of the non-sheet-passing portion T2. Therefore, the absolute value of the surface potential of the photosensitive drum 1 on the outer side with respect to the sheet edge B1A when the skew or size mismatch is assumed can be small. This can suppress flowing-in of the transfer current from the sheet-passing portion T1 to the non-sheet-passing portion T2.

In order to suppress the soiling on the recording medium PA as described above, control is performed as follows in the present exemplary embodiment.

When the toner image is formed on the recording medium P, control is performed such that the photosensitive drum 1 enters the transfer nip portion Nt in a state where the absolute value of the surface potential of the photosensitive drum 1 becomes gradually smaller toward the outside in the rotational axis direction of the photosensitive drum 1 in the third region. Alternatively, control is performed preferably such that the photosensitive drum 1 enters the transfer nip portion Nt in a state where the surface potential of the third region has a smaller absolute value than that in the region where the toner image is not formed in the first region.

As a result, it was confirmed that in Example 2, the transfer memory is reduced even if an exposed sheet having a high resistance value is used, and the sheet edge soiling is suppressed even if the recording medium P skews or a recording medium PA having a mismatched size is conveyed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-088843, filed May 2, 2018, which is hereby incorporated by reference herein in its entirety.

What is claimed is:

1. An image forming apparatus comprising:

a rotatable image bearing member for bearing a toner image;

a charging member configured to charge a surface of the image bearing member;

a developing member configured to develop the toner image on the image bearing member by supplying toner to the surface of the image bearing member charged by the charging member;

a transfer member configured to form a nip portion by contacting with the image bearing member, and to transfer the toner image developed on the image bearing member at the nip portion to a recording medium;

a voltage applying unit configured to apply a transfer voltage to the transfer member while the toner image is transferred from the image bearing member to the recording medium; and an acquisition unit configured to acquire information on a size of the recording medium, wherein in a region where the nip portion of the image bearing member is formed, a region in which the toner image can be formed is defined as a first region, a region where the recording medium does not pass while the recording medium is conveyed by the nip portion is defined as a second region, and a region of the image bearing member between the first region and the second region is defined as a third region, wherein, based on the information acquired by the acquisition unit, an edge position of the recording medium in a direction perpendicular to a conveyance direction of the recording medium and an edge position of the first region are identified, and wherein in forming the toner image on the recording medium, the image bearing member enters the nip portion in a state where the third region of the image bearing member includes a region in which an absolute value of a surface potential is smaller than an absolute value of a surface potential of a region in which the toner image is not formed in the first region.

2. The image forming apparatus according to claim 1 further comprising:

an exposure unit configured to perform first exposure to form a potential that does not form the toner image on the surface of the image bearing member charged by the charging member, and second exposure with an exposure amount that is larger than an exposure amount of the first exposure to form a potential that forms the toner image to form a latent image on the surface of the image bearing member; and a control unit configured to control an exposure amount of the exposure unit, wherein in forming the toner image on the recording medium, the control unit controls the exposure amount to make the exposure amount of a region included in the second region of the image bearing member when the first exposure is carried out on the second region larger than the exposure amount of the first region to adjust the surface potential of the image bearing member entering the nip portion.

3. The image forming apparatus according to claim 1, wherein in forming the toner image on the recording medium, the image bearing member enters the nip portion in a state where an absolute value of a surface potential in the second region of the image bearing member is smaller than the absolute value of the surface potential of the region in which the toner image is not formed in the first region.

4. The image forming apparatus according to claim 1, further comprising:

a resistance measuring unit configured to measure an electrical resistance of the transfer member, wherein the control unit controls the surface potential of the image bearing member based on a measurement result of the electrical resistance of the transfer member acquired by the resistance measuring unit.

5. The image forming apparatus according to claim 1, further comprising:

a second resistance measuring unit configured to measure an electrical resistance of the recording medium, wherein the control unit controls the surface potential of the image bearing member based on a measurement result of the electrical resistance of the recording medium acquired by the second resistance measuring unit.

6. The image forming apparatus according to claim 1, further comprising:

a detection unit configured to detect temperature and humidity, wherein the control unit controls the surface potential of the image bearing member based on information acquired by the detection unit.

7. The image forming apparatus according to claim 1, further comprising:

a second detection unit configured to detect the size of the recording medium, wherein the information acquired by the acquisition unit is based on information on the size of the recording medium detected by the second detection unit.

* * * * *